United States Patent [19]

Osaka et al.

[11] Patent Number: 4,503,900

[45] Date of Patent: Mar. 12, 1985

[54] VENETIAN BLIND CONSTRUCTION

[75] Inventors: Susumu Osaka, Machida; Midori Sagawa, Sagamihara, both of Japan

[73] Assignee: RCA Corporation, New York, N.Y.

[21] Appl. No.: 408,501

[22] Filed: Aug. 16, 1982

[51] Int. Cl.[3] ..... E06B 9/30

[52] U.S. Cl. ..... 160/172; 160/176; 160/107

[58] Field of Search ..... 160/107, 168–178

[56] References Cited

U.S. PATENT DOCUMENTS

| | | | |
|---|---|---|---|
| 1,958,074 | 5/1934 | Seregi | 160/107 |
| 2,179,882 | 11/1939 | Darre | 160/172 |
| 2,876,834 | 3/1959 | Walker | 160/168 |
| 3,443,624 | 5/1969 | Toth | 160/176 |
| 3,559,024 | 1/1971 | Marder | 318/467 |
| 3,646,877 | 3/1972 | Ellis | 90/110 |
| 3,717,195 | 2/1973 | Larranaga | 160/169 |
| 3,809,143 | 5/1974 | Ipekgil | 160/168 |
| 3,818,969 | 6/1974 | Debs | 160/172 |
| 3,878,877 | 4/1975 | Bruneau et al. | 160/168 |
| 4,047,554 | 9/1977 | Bullat | 160/168 |
| 4,103,727 | 8/1978 | Spohr | 160/168 R |

FOREIGN PATENT DOCUMENTS 1539457 10/1967 France .

*Primary Examiner*—Peter M. Caun

*Attorney, Agent, or Firm*—Joseph S. Tripoli; George E. Haas; William Squire

[57] ABSTRACT

A plurality of slats are selectively rotated or folded by a set of self-locking and self-releasing clutch mechanisms coupled to and responsive to the rotation of corresponding rotating threaded shafts.

18 Claims, 16 Drawing Figures

VENETIAN BLIND CONSTRUCTION

The present invention relates to the construction of and apparatus employed in a Venetian blind.

A Venetian blind includes a plurality of parallel slats which are rotated in unison about parallel axes to control the amount of light passing through the blind and which are "folded" (drawn together) to uncover a portion or all of the opening covered by the blind. Usually the slats are horizontal, being interconnected and supported by fabric tapes. The tapes can be moved to rotate the slats. Strings or cords connected to the bottommost member of the structure are adapted to raise that bottommost member to cause it to draw the slats together and raise them.

Alternatively, the slats can be vertical rather than horizontal. In this case, the slats are attached at their upper ends to a mechanism which rotates the slats in unison about parallel axes and which selectively folds the slats to one side of the blind to thereby clear the opening.

Examples of Venetian blinds with horizontal slats are shown in U.S. Pat. Nos. 2,876,834; 3,809,143; 3,559,024; and 3,646,877 and with vertical slats are shown in U.S. Pat. Nos. 4,103,727; 3,878,877; and 4,047,554. In addition, French Pat. No. 1,539,457 illustrates a mechanism for operating vertical slats.

Of interest is copending application Ser. No. 231,856, filed Feb. 5, 1981, entitled "Venetian Blind Construction," by Osaka et al., and Ser. No. 231,858, filed Feb. 5, 1981, entitled "Shutter Construction," by Osaka et al., now U.S. Pat. No. 4,427,048 both assigned to the assignee of the present invention.

All of the above-mentioned disclosures relating to Venetian blinds with horizontal slats, depend on gravity for folding and unfolding the slats. This has the disadvantage of limiting the blind orientation parallel to the direction of gravity to provide the folding or unfolding force. In some implementations this reliance on gravity for folding or unfolding the slats may not always be feasible.

A Venetian blind construction including a plurality of slats in accordance with one embodiment of the present invention comprises first and second threaded shafts for rotation about respective parallel axes and means secured to the shafts for rotating the slats about a corresponding plurality of parallel axes in response to the rotation of the shafts. Slat rotating and folding means including clutch means secured to and responsive to the rotation of the first and second threaded shafts selectively displace the slats in a direction parallel to the shaft axes regardless the orientation of said slats with respect to the direction of gravity and for selectively rotating the slats about the corresponding parallel axes.

In accordance with a feature of the present invention, in a Venetian blind apparatus for selectively rotating and displacing a slat, a threaded rod is adapted to be rotated about its long axis. A rotatable gear threaded about its axis of rotation is included, with the gear threads being engaged with the rod threads. Means selectively restrain the gear from rotation so that it displaces along the length of the rod in response to the rotation of the rod about its axis. Means selectively lock the gear to the rod so that the gear is selectively rotated by the rod. A member includes means coupled to and responsive to the rotation and displacement of the gear for selectively displacing and rotating the slat.

Figure 2:
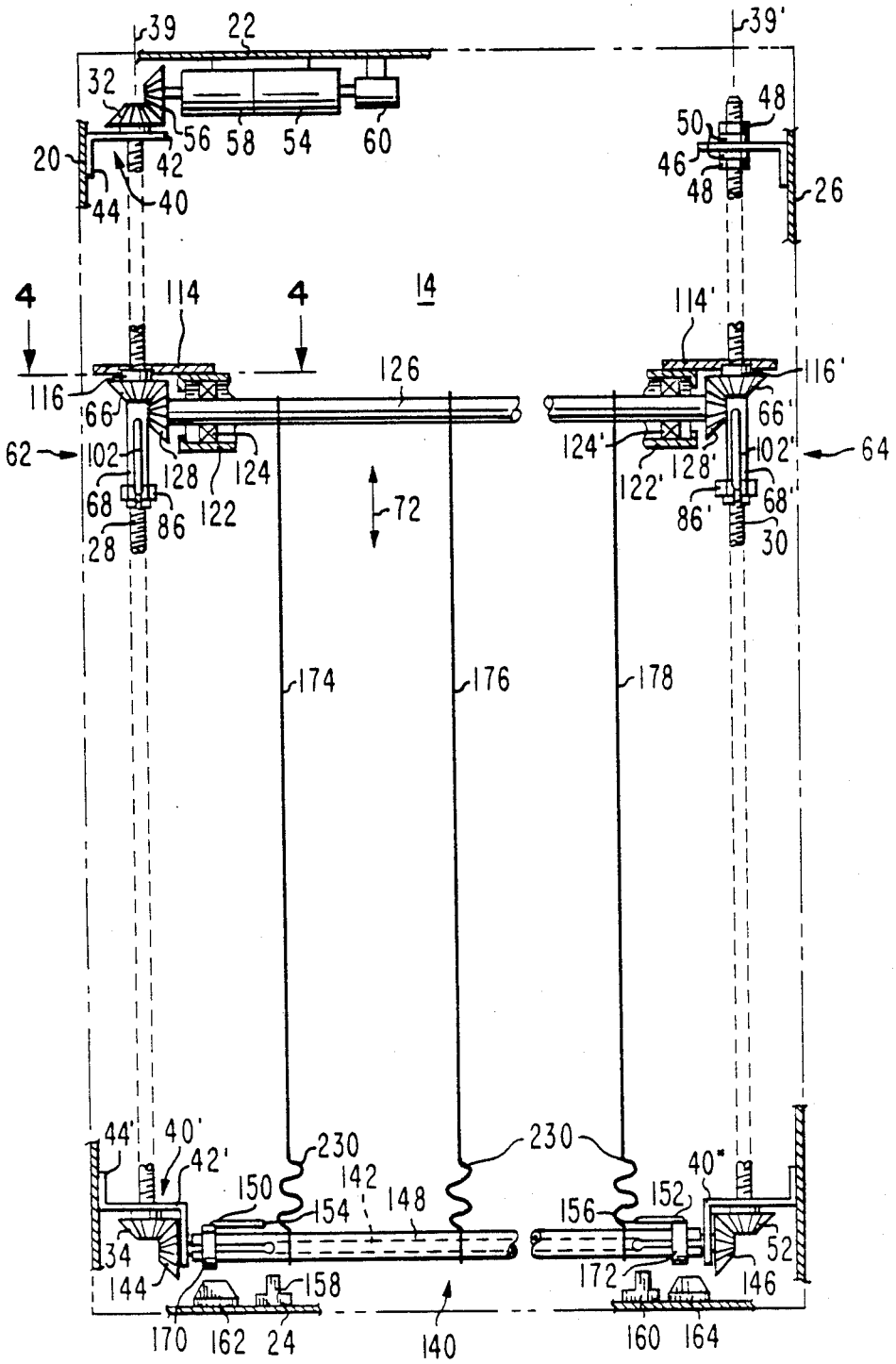
FIG. 2 is a fragmented front elevation view of the slat operating mechanism employed in the embodiment of FIG. 1.
Figure 4A:
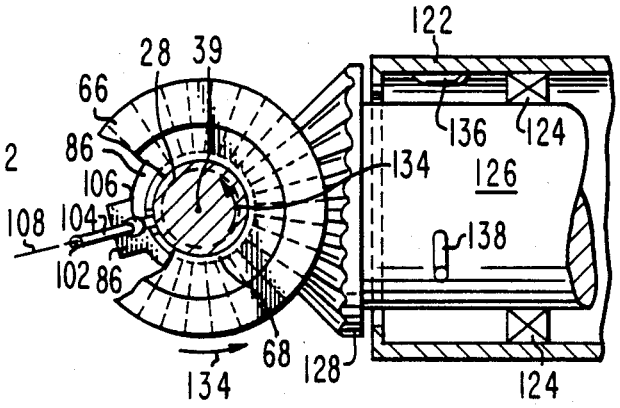
Figure 4B:
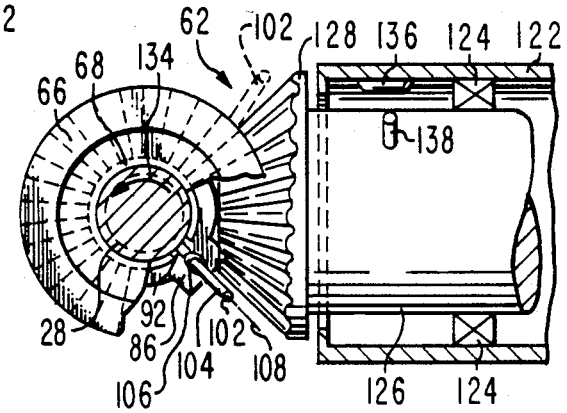
Figure 4C:
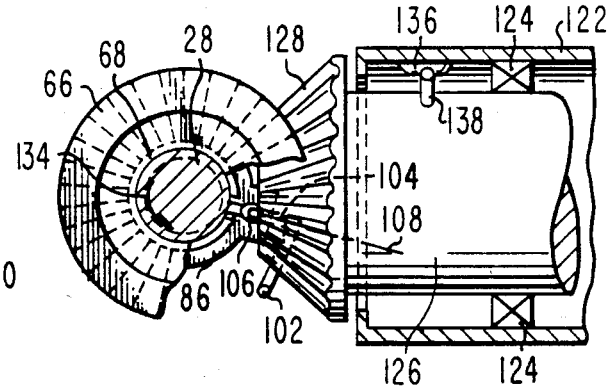
Figure 5:
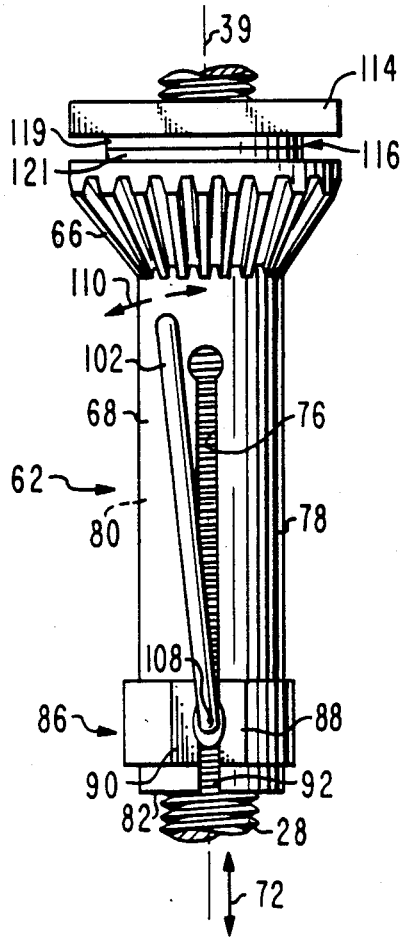
Figure 6:
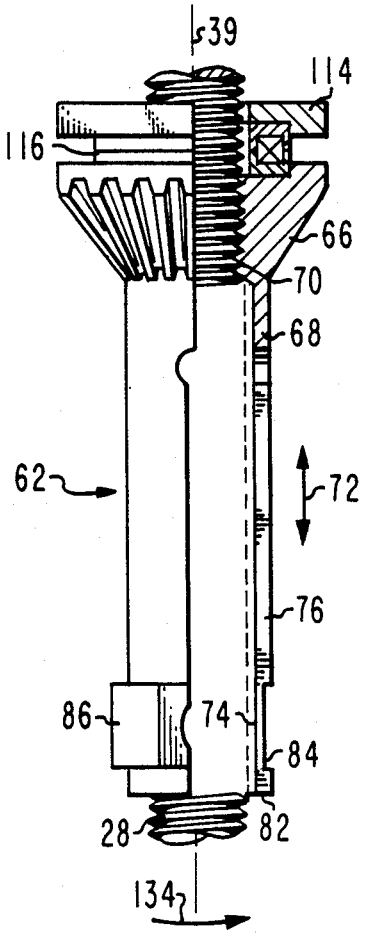
Figure 7:
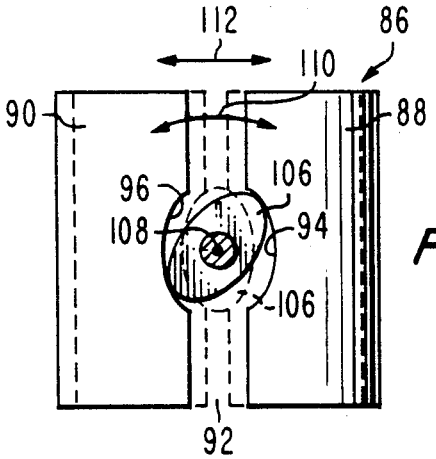
Figure 8:
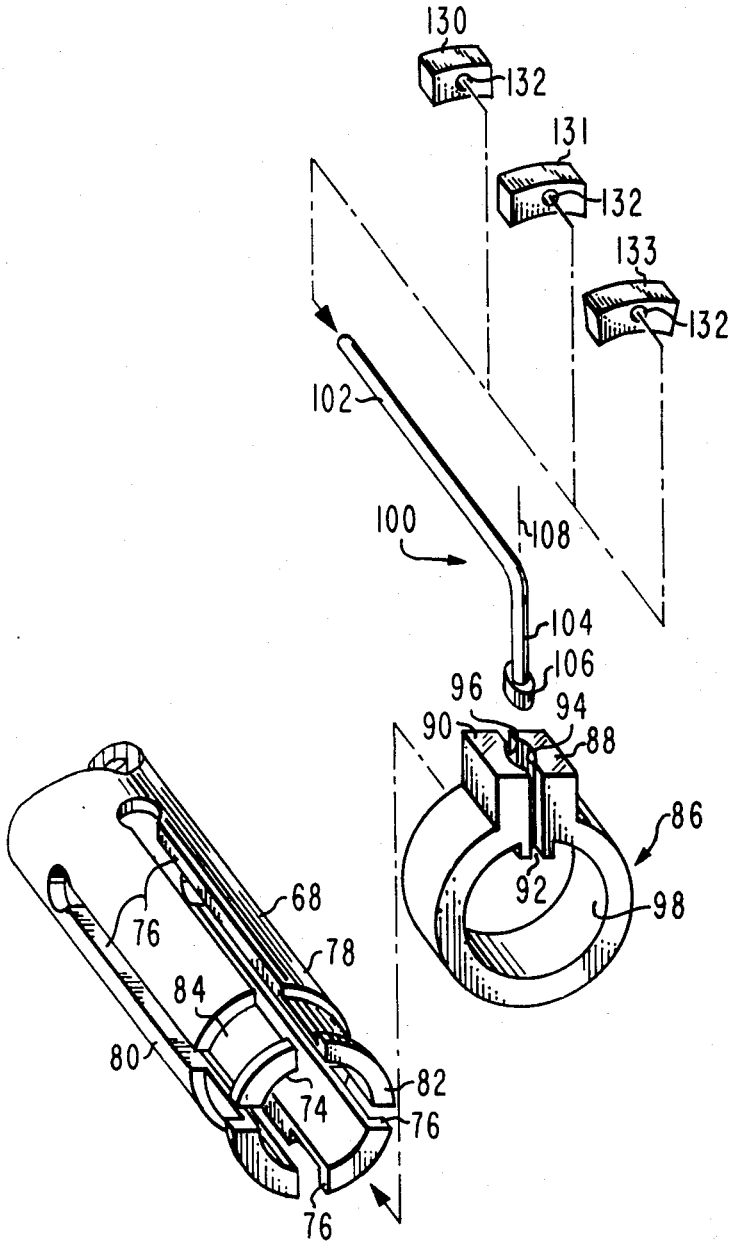
Figure 9A:
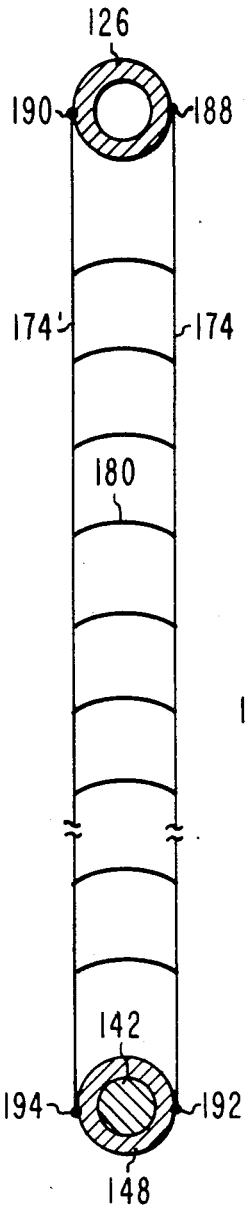
Figure 9B:
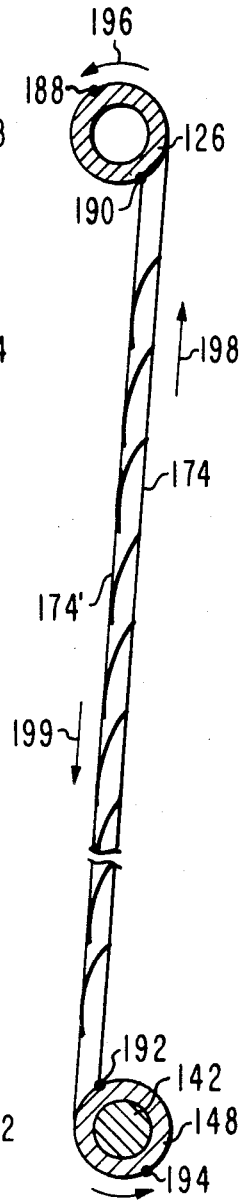
Figure 9C:
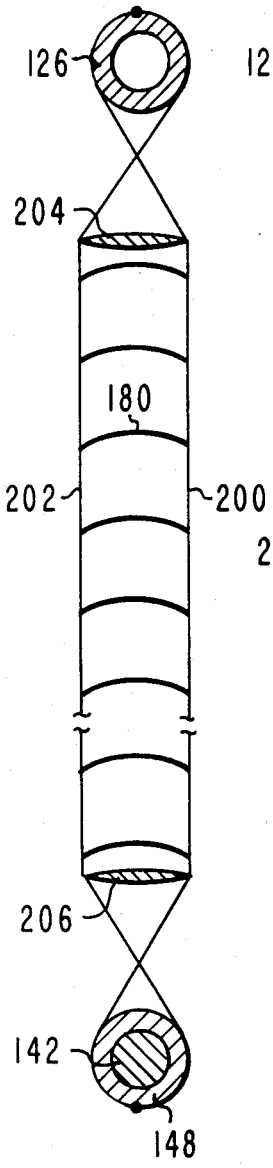
Figure 9D:
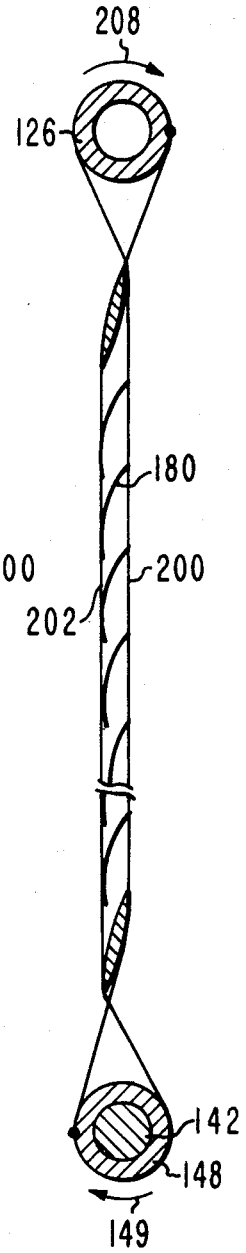
Figure 10:
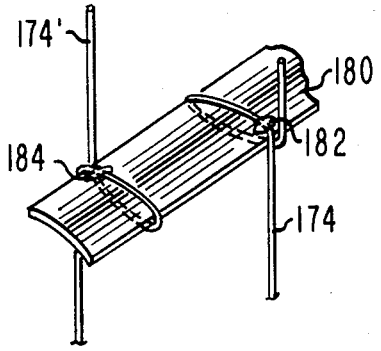
Figure 11:
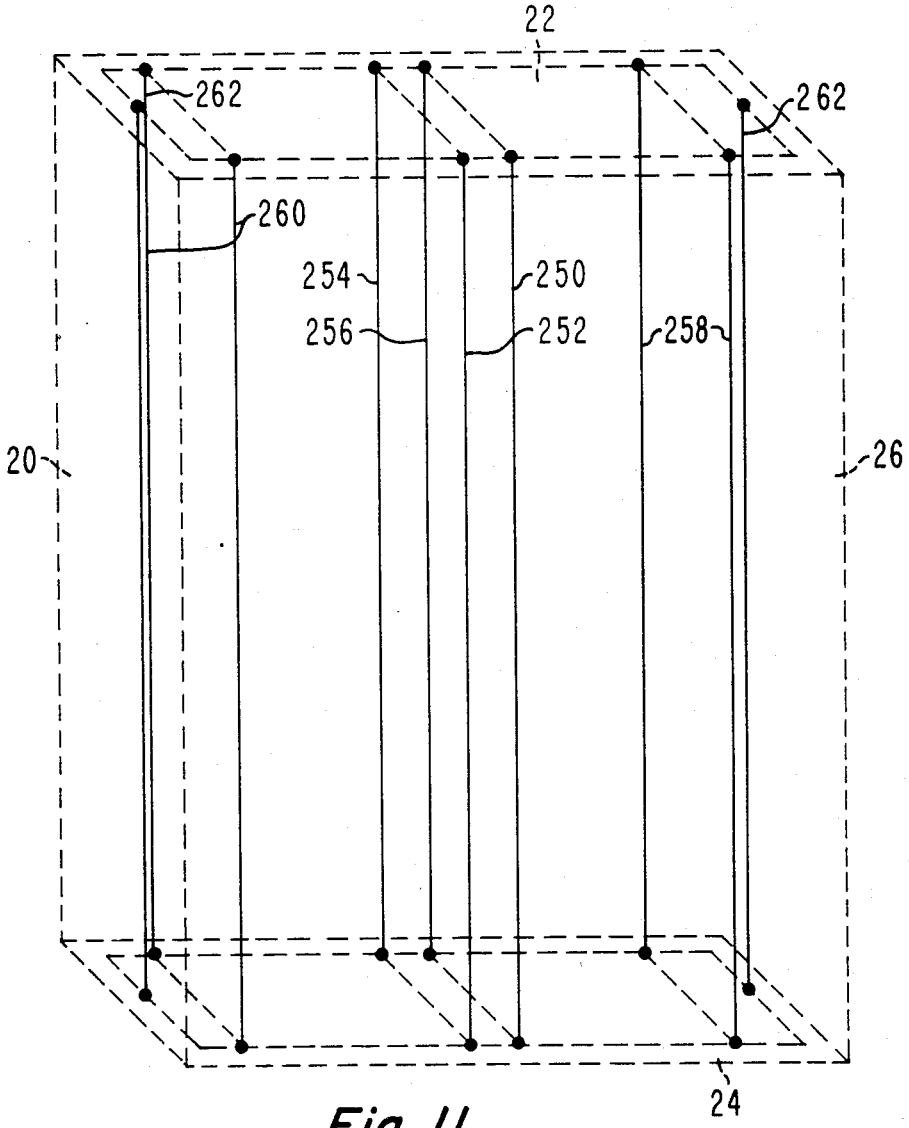

FIGS. 4*a*, 4*b* and 4*c* are sectional views taken along lines 4—4 of FIG. 2 showing different stages of operation of the mechanism of FIG. 2;

FIG. 5 is an elevation view of the clutch mechanism of FIG. 2;

FIG. 6 is a partial sectional view of the mechanism of FIG. 5;

FIG. 7 is a front elevation sectional view of the clutch camming portion of the mechanism of FIG. 5;

FIG. 8 is an exploded view of several of the elements (including several optional elements) of the mechanism of FIG. 5;

FIGS. 9*a*, 9*b*, 9*c*, and 9*d* illustrate elements employed to attach the slats to the mechanism of FIG. 2, FIGS. 9*a* and 9*b* illustrating one embodiment and FIGS. 9*c* and 9*d* a second embodiment;

FIG. 10 is an isometric view of a portion of the elements of FIGS. 9*a*–9*d* showing attachment of the slats to the slat supporting strings; and FIG. 11 is an isometric view of a construction employed to restrain the slats regardless their orientation.

Figure 1:
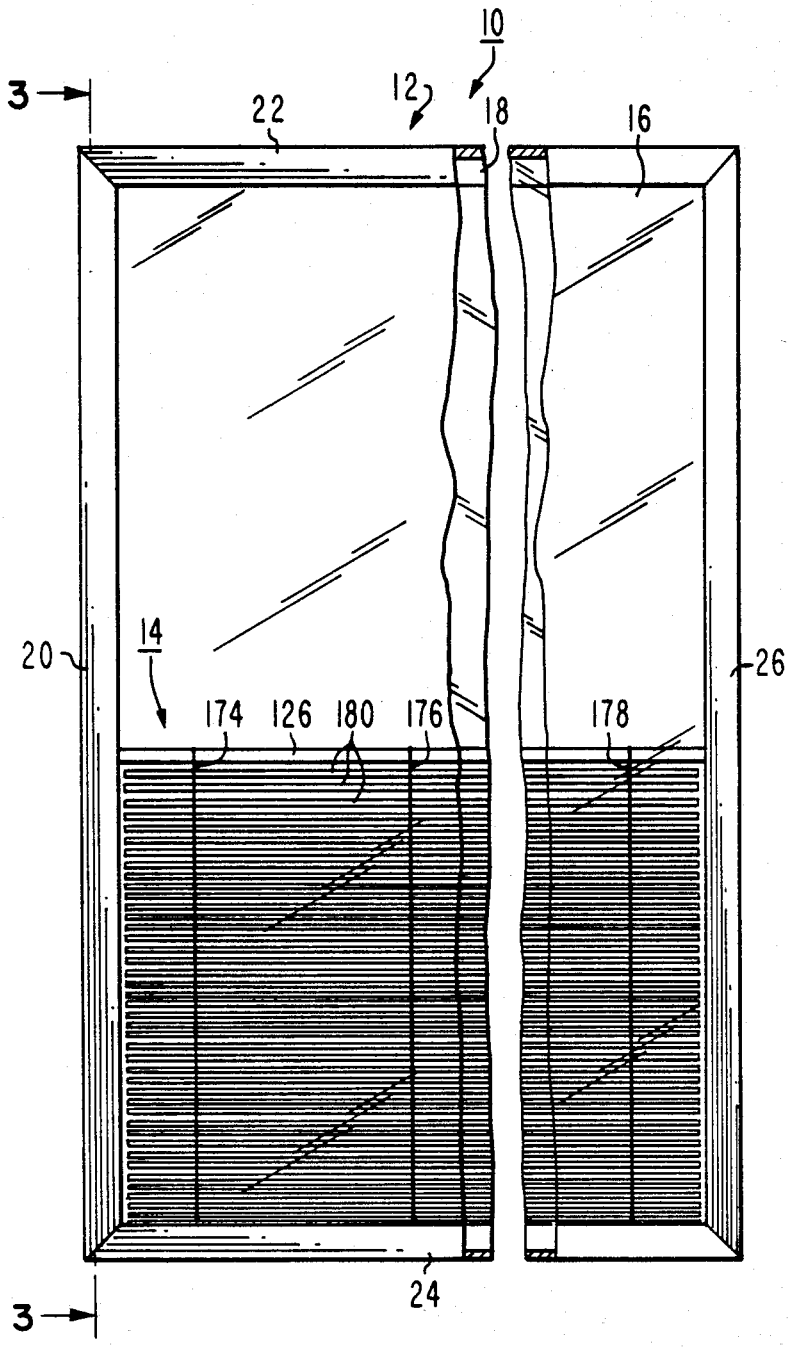
FIG. 1 is a front elevation fragmented view of a Venetian blind in accordance with one embodiment of the present invention.

In FIG. 1 Venetian blind 10 includes a frame 12 to which a blind structure 14 is secured. Blind structure 14 is between two clear panes 16 and 18 of glass or other transparent material such as clear plastic. The panes 16, 18 FIG. 3, may be mounted in corresponding channels formed in the frame 12. Frame 12 may be formed of lightweight sheet aluminum and may be extruded, stamped, or formed in any other manner. The panes 16, 18, and frame 12 contain the blind structure 14 protecting it from dust and dirt, and serving as a sound suppressing medium.

The blind 10 forms a comprises an assembly which may be easily handled and installed in any orientation. For example, the blind may be oriented as shown in FIG. 1 with the slats horizontal or it may be rotated 90° from this position so that the slats are vertical. Further, the blind may be oriented so that the planes 16, 18 are vertical as shown in FIG. 1, or horizontal, or at any other angle. As will be evident after the following description, the slats may be folded or unfolded without depending upon gravity. As a result, the blind 10 has considerably more flexibility and utility than prior blind constructions.

In FIG. 1, the frame 12 comprises two short channel sides 22 and 24 joined at their ends to two long channel sides 20 and 26. In practice, either the long or the short sides of the frame can be perpendicular to the slats depending upon the design requirement.

Blind structure 14, FIG. 2, is secured to the frame 12 to and within the channels of sides 20, 22, 24, and 26. Only so much of the sides 20–26 are shown as to show the relationship to the structure 14, the remainder being indicated by a broken line.

Figure 3:
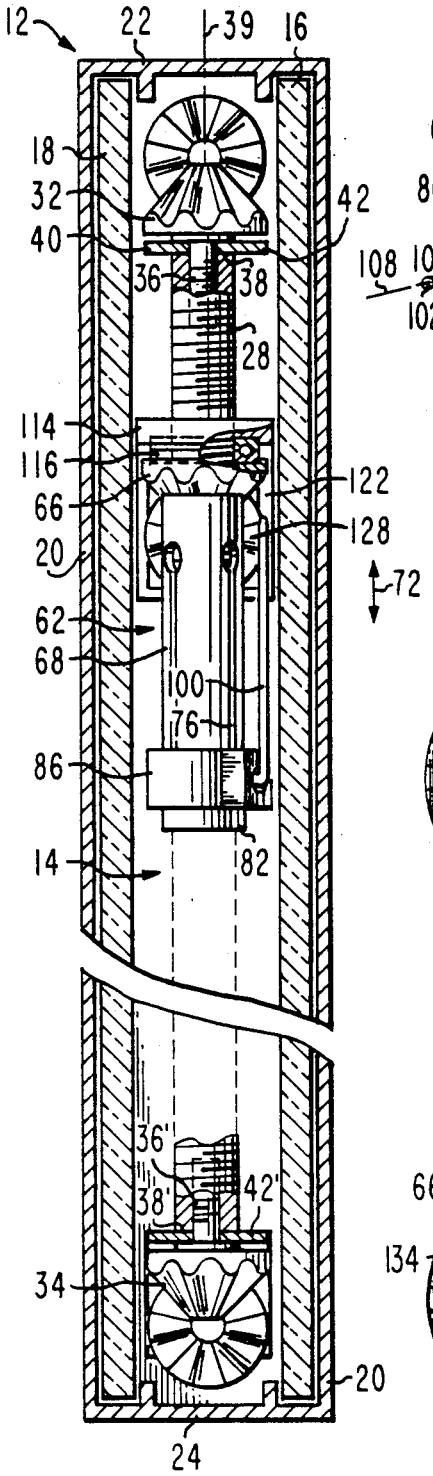
FIG. 3 is an end sectional view of the embodiment of FIG. 1 taken along lines 3—3.

In FIG. 2 structure 14 includes two threaded parallel shafts 28 and 30 which may be, for example, conventional screw bolts. The threads of the shafts 28 and 30 extend substantially the entire length of the shafts. Secured to opposite ends of shaft 28 are like constructed bevel gears 32 and 34, respectively. FIG. 3 shows details of the attachment of bevel gear 32. The gear 32 includes an integral depending threaded stud 36 which is screwed into a mating threaded hole in shaft 28. The gear 32 is securely fastened to the shaft 28 so that both the gear 32 and shaft 28 rotate as an integral unit about axis 39 which coincides with the long axis of shaft 28. In the alternative, the threaded shaft 28 may be screwed into a threaded hole (not shown) in the gear 32. Gear 34 at the other end of shaft 28 is similarly securely fastened to shaft 28 with stud 36'. Annular groove 38 is formed between the gear 32 and the shaft 28.

L-shaped bracket 40 (FIGS. 2 and 3), formed of sheet metal or other material, has a leg 42 which fits within the groove 38. The shaft 28 rotates while the leg 42 remains stationery. The leg 42 is captured so that it does not displace in a direction parallel to axis 39 along shaft 28. Leg 44 on bracket 40 is at right angles to leg 42 and is secured to side 20 of frame 12, such as by bolts. Gear 34 is fastened to the threaded shaft 28 in an identical manner as gear 32 and to side 20 by bracket 40' via leg 42' secured to groove 38' and leg 44' secured to side 20.

Bolt 30 (FIG. 2) is secured at one end to the side 26 of frame 12 by L-shaped bracket 46. Bracket 46 is captured to shaft 30 by a pair of nuts 48 and washers 50. Washers 50 abut the bracket 46 so that the shaft 30 may rotate with respect to the bracket but preclude shaft 30 motion in a direction parallel to axis 39'. Axis 39' is the axis of rotation of the shaft 30 and is centered along the shaft 30 parallel to axis 39 about which shaft 28 rotates. The lower end of shaft 30 is secured to side 26 identically as shaft 28 to side 20. This shaft 30 end is secured to side 26 by bracket 40'' which may be a mirror image of bracket 40' and which is captured to shaft 30 by bevel gear 52. Bevel gear 52 is attached to shaft 30 identically as gear 32 to shaft 28. As thus described, the shafts 28 and 30 are free to rotate about their corresponding parallel respective axes 39 and 39' but may not displace in any direction with respect to the frame 12.

A motor 54 is secured to frame 12 side 22 for rotating bevel gear 56 via gear box 58, secured to side 22. A source of power (not shown) operates the motor 54 through switch 60. Motor 54 selectively rotates bevel gear 56 in two opposite directions, as selected by the switch position of switch 60. Gear 56 engages and rotates gear 32.

A clutch mechanism 62 is secured to shaft 28 and a similar mechanism 64 is secured to shaft 30. Clutch mechanisms 62 and 64 are the same in construction and therefore only one will be described.

As shown in FIGS. 5 and 6, the clutch mechanism 62 comprises a bevel gear 66 from which depends an integral clutch sleeve 68. Gear 66 has an internal threaded bore 70 which engages the threads of shaft 28. The bore 70 is centered on axis 39 so that if the gear 66 remains stationery and the shaft 28 rotates about axis 39, the gear 66 is displaced in the directions 72 along axis 39 in accordance with the direction of rotation of the shaft 28.

Rotation of the shaft 28 about axis 39 in a clockwise direction, in a view from the top of the drawing to the bottom of the drawing, would displace the gear 66 toward the top of the drawing FIG. 6. Rotation of the shaft 28 in the opposite direction would move the gear 66 toward the bottom of the drawing. Sleeve 68 rotates and linearly displaces in either of directions 72 with the gear 66.

Sleeve 68 has a central unthreaded bore 74 which extends parallel to shaft 28 centered around axis 39. Sleeve 68 has four slits 76, FIG. 5, which extend along most of the length of the sleeve 68. Slits 76 are equally spaced from each other. Slits 76 permit the walls such as walls 78 and 80 of sleeve 68 to be resilient in the direction normal to axis 39. Bore 74 is slightly larger than the outer diameter of the threads of shaft 28 so that the shaft 28 is free to rotate within the bore 74. The slits 76 are in communication with and open to end 82 of sleeve 68.

As best seen in FIG. 8, an annular groove 84 is formed in sleeve 68 close to end 82. An annular clamping ring 86 formed with a slit 92 fits in groove 84. Slit 92 may be aligned with one of four slits 76 in sleeve 68. The ends of the ring 86 adjacent slit 92 are formed into bosses 88 and 90 having facing camming surfaces 94 and 96, respectively, forming a portion of the slit 92. The clamping ring 86 may be formed of hardened steel and has a central bore 98. The bore 98 is smaller in diameter than the outer diameter of the groove 84 in sleeve 68 so that in the free state of ring 86 the ring compresses the sleeve 68 at the groove 84, reducing the diameter of bore 74 of sleeve 68. The inner surface of bore 74, when it is of reduced diameter, engages the outer surface of shaft 28, FIG. 6, whereby the sleeve 68 becomes tightly clamped to the shaft 28 so that when shaft 28 rotates about axis 39, the sleeve 68 and gear 66 both rotate therewith.

When the sleeve 68 is in its free condition, that is, in the absence of the clamping force exerted by clamping ring 86, its bore 74 is of larger diameter than the shaft 28 and the sleeve 68 is free to move in the axial direction directions 72, relative to shaft 28. Thus, should the bore 98 of ring 86 be made sufficiently large that its inner surface exerts no pressure against the grooved region 84 of the sleeve 68, then through the resilient action of the sleeve material, the four walls including 78 and 80 will move apart and release the shaft 28, and the sleeve 68 will be free to slide over shaft 28, FIG. 6.

Camming assembly 100, FIG. 8, comprises a bent lever arm 102 having a leg 104 at the end of which is attached camming member 106. The member 106 may be a solid elliptical member in the shape somewhat of an egg. Member 106 slips between the camming surfaces 94 and 96 so that the arm 102 is generally parallel to axis 39. The arm 102 is generally at a right angle to leg 104, the leg 104 being rotatable about axis 108, normal to axis 39, axis 108 passing through camming member 106.

Referring to FIG. 5, rotation of the arm 102 in directions 110 about axis 108 rotates the camming member 106. When the arm 102 of FIG. 5 is parallel to axis 39, the small dimension of the camming member 106 is across slit 92 so that the slit 92 is at its smallest value. In this position of the arm 102, bosses 88 and 90 are closest together and resiliently clamp all four walls of the sleeve 68 together to form a locking clutch to lock the sleeve 68 to the shaft 28. When the arm 102 is rotated in either of directions 110, the member 106 is rotated so that its longer dimension rotates in a direction to open the space between bosses 88 and 90 and thus widen slit 92. This permits the four walls of the sleeve 68 to naturally open to their free position and thus release the sleeve 68 from the shaft 28.

This action can be seen more clearly in FIG. 7. The dashed lines show the clamping ring 86 in the clamping position. The solid lines show the clamping ring in the unclamped or clutch release state. In the clamped state the long axis of the camming member 106 is parallel to the slit 92. In the unclamped or released state the bosses 88 and 90 are moved away from each other in directions 112, opening the slit 92 as shown in solid.

The bevel gear 66 is secured to a support frame 114, FIGS. 2, 5, and 6, by a bearing 116. Support frame 114 is generally normal to axis 39 and may comprise sheet metal. Support frame 114 is rotationally secured to the gear 66 by bearing 116. Bearing 116 may have one race 119, FIG. 5, secured to support frame and its other race 121 secured to gear 66. As a result, the gear 66 may rotate without rotating the support member frame but any displacement of the gear 66 in the vertical directions 120 will displace the support frame 114.

Depending from support frame 114 is a bearing support 122, FIG. 2. Bearing support 122 is secured to the frame 114 in fixed relationship. A bearing 124 is secured to the bearing support 122. A similar assembly 114' is rotatably secured to the gear clutch mechanism 64 coupled to the threaded shaft 30. The elements in mechanism 64 with primed reference numerals on the various assemblies correspond to like parts with the unprimed numerals on mechanism 62.

A circular shaft 126 is rotatably mounted in bearings 124, 124'. A bevel gear 128 is secured to one end of shaft 126 and a like bevel gear 128' is secured to the other end of shaft 126. Gear 128 mates with gear 66 and is always engaged with gear 66 by means of the frame 114 and bearing 124. Similarly, the gear 128' is always engaged with the gear 66' by means of the frame 114' and bearing 124'. The shaft 126 rotates about an axis normal to axes 39 and 39'. Rotation of the gear 66 thus rotates the gear 128 and shaft 126.

In FIG. 2 the arm 102 is sufficiently long such that when positioned in a portion of an angular segment around axis 39 the upper end of arm 102 abuts gear 128. For example, looking from the top of the drawing to the bottom of the drawing, the arm 102 will contact the side of the gear 128 facing the viewer when the gear 66 is rotated counterclockwise. When the gear 66 is rotated clockwise, the arm 102 will rotate behind the shaft 28 in the view of FIG. 2 and contact the side of the gear 128 opposite the one facing the viewer. By comparing the arm 102 position shown in phantom, FIG. 4*b*, to its position shown in solid line, it is apparent arm 102 and thus gears 66 and 128 rotate through an angle greater than about 270°. However, this angular rotation may be set at a value of approximately 180° by a selected one of camming devices 130, 131, and 133, FIG. 8, adjust this angle. Camming device 131 is larger than the device 130 and the camming device 133 is larger than the device 131. Each of the devices has a central bore 132 which closely receives the arm 102. The camming devices 130, 131, or 133 abut the gear 128 and set the angle through which the arm 102 is permitted to rotate about axis 39. This action accordingly sets the angle through which shaft 126 rotates, and thus sets the angle through which the slats 180, FIG. 1, rotate as will be explained later.

In operation, FIG. 4*a*, arm 102 is upright, parallel to axis 39. In this position the camming member 106 is oriented as shown in dashed lines FIG. 7. In this case the slit 92, FIG. 7, is in its narrowest condition and the sleeve 68 is clamped tightly against the shaft 28 by ring 86. Assuming the switch 60, of FIG. 2 is closed supplying power to motor 54, this rotates gear 32 and shaft 28 and thus gear 66 in a selected one of two directions. Assuming that shaft 28 is rotated in direction 134, the clutch engagement of sleeve 68 to shaft 28 also rotates sleeve 68 and gear 66 in the same direction 134. With the switch 60 closed, shaft 28 continues to rotate in direction 134 until the arm 102 is positioned as shown in FIG. 4*b*. At this point, the arm 102 is closely spaced to the crests of the teeth of gear 128. Assuming the shaft 128 is continued to be rotated in direction 134, gear 66 will be rotated to the position shown in FIG. 4*c*. In FIG. 4*c* the arm 102 has contacted the crests of gear 128 teeth and the driving force of the shaft 28 rotates the arm 102 about axis 108, rotating the camming member 106. This widens the slot 92, FIG. 7, permitting the four walls including 78 and 80, FIG. 5, of the sleeve 68 to open, releasing the sleeve 68 and thus gear 66 from the rotational drive force of shaft 28. Further rotation of the shaft 28 does not further rotate gear 66 due to the abutment of arm 102 with gear 128 and the slip fit between sleeve 68 and the shaft 28. Rotation of the gear 66 through the various steps shown in FIGS. 4*a*, 4*b*, and 4*c* rotates shaft 126 by the engagement of gear 66 with gear 128.

If desired, a stop 136 on bearing support 122, FIGS. 4*a*, 4*b*, and 4*c*, and stop projection 138 in shaft 126 may be included. Stop 136 and projection 138 limit the angle through which shaft 126 may rotate. Stop projection 138 abuts stop 136 when the shaft 126 has rotated through the desired angle. Projection 138 and stop 136 prevent overtravel of gear 66 and shaft 126. Of course, shaft 126 must rotate a minimum angular extent necessary for the sleeve 68 to be released from shaft 28. Stop 136 is located accordingly.

Because gear 66 is threaded to shaft 28, FIG. 6, the gear 66 is linearly displaced in one of directions 72 as shaft 28 continues to rotate after sleeve 68 is released from shaft 28. The gear 66 and sleeve 68 move toward the bottom of the drawing when the shaft 28 rotates in direction 134, FIGS. 4*a*, 4*b*, and 4*c*. Thus, there is also linear displacement in directions 72 of the bearing 116 and the frame 114 carried by the bearing 116. Since the frame 114 supports the shaft 126, the shaft 126 and its driving gear 128 remain aligned with and engaged with gear 66, regardless the displacement of the gear 66 in directions 72, FIG. 6.

Should the shaft 28 be turned in a direction opposite direction 134, FIGS. 4*a*, 4*b*, and 4*c*, then a reverse action will occur. In this case, due to the natural spring force of the clamping ring 86 to close slit 92, the forces being transferred to cam 106, arm 102 is rotated to its upright position parallel to axis 39, FIG. 5 in one of directions 110, FIG. 5. The clamping ring 86 then clamps and locks the sleeve 68 to the threaded shaft 28. Continued rotation of the shaft 28 in the direction opposite to direction 134 will then rotate the gear 66 in that opposite direction, also rotating the engaged gear 128 in the opposite direction which rotates shaft 126. Shaft 126 rotates in the opposite direction until arm 102 engages the other side of gear 128 opposite to that shown in FIG. 4*c*. At that point the arm will be positioned as shown dashed in FIG. 4*b*. Rotation of the gear 66 will position the arm adjacent gear 128 opposite to the position shown in FIG. 4*c* once again releasing the sleeve 68 from the shaft 28. At this point, the shaft 126 will have been rotated more than 270° as shown in FIGS. 4*a*, 4*b* and 4*c* or about 180° from the position shown when a selected one of devices 130, 131 or 133, FIG. 8, are employed. A stop and stop projection similar to the stop 136 (not shown) and projection 138 (not shown) prevent overtravel of the shaft 126 in this opposition direction. The positioning of one of the devices 130, 131 and 133 on the end of the arm 102, FIG. 8, permits accurate setting of the arm 102 to the desired angular position at which the gear 66 is to be released from the shaft 28.

In FIG. 2, the clutch mechanism 64 operates in substantially the same manner as the mechanism 62 just described. Thus, the rotation of the gear 66' is in unison with gear 66 and the gear 128' is in unison with gear 128 so that they together rotate the shaft 126.

The shaft 30, however, is rotated through a drive assembly 140 which is driven by shaft 28. Drive assembly 140 couples the rotary motion of shaft 28 to shaft 30. The drive assembly 140 includes a drive shaft 142 and two bevel gears 144 and 146 at opposite ends of shaft 142. Shaft 142 is supported by legs depending from brackets 40' and 40''. Gear 144 engages gear 34 and the gear 146 engages gear 52. These gears are in positive engagement at all times and directly couple the shaft 30 to the shaft 28 so that shaft 30 always rotates when shaft 28 rotates. Shaft 30 may be a left-hand screw in this case since it is driven in the opposite direction as shaft 28. Shaft 30 always rotates about its axis 39' parallel to axis 39. Whenever shaft 28 rotates, shaft 30 rotates, and the clutch mechanisms 62 and 64 act in unison and cooperate to rotate the shaft 126 in the same direction.

The drive assembly 140 includes a sleeve 148 which closely receives shaft 142 but which can rotate with respect to shaft 142. A clutch assembly 150 is secured to one end of sleeve 148. A second clutch assembly 152 which is a mirror image of assembly 150, is at the other end of sleeve 148. Clutch assemblies 150, 152 are substantially similar as the clutch arrangement formed by sleeve 68, FIG. 5, and arm 102, clamping ring 86, and cam member 106. Thus, the sleeve 148 is normally resiliently clamped to shaft 142 by the clamp assembly 150 at one end and the clamp assembly 152 at the other end. When the clamping arm 154 of assembly 150 is rotated in the same angular segment as shaft 126, the arm 154 engages stop 158 which rotates the arm 154 and disengages the sleeve 148 from shaft 142 permitting shaft 142 to rotate without rotating sleeve 148. At the same time the arm 156 of assembly 152 engages stop 160 and this stop disengages the corresponding end of sleeve 148 from shaft 142. An overtravel preventing stop 162 is located at one end of sleeve 48 and secured to side 24 of frame 12 and a second overtravel preventing stop 164 is at the other end of the sleeve 148 on side wall 24. Stops 162 and 164 engage the legs of arms 154 and 156 corresponding to leg 104 of assembly 100, FIG. 8. These stops prevent overtravel of the sleeve 148 in a similar manner as the stops 136 and stop projection 138, FIGS. 4*a*, 4*b*, and 4*c*, described above, so that the sleeve 148 rotates through the same angular segment as the shaft 126. Rotation of the sleeve 148 tends to rotate the arms 154 and 156 unlocking the clamping rings 170 and 172, which are similar to ring 86, FIG. 8, on opposite ends of the sleeve 148.

Secured to the shaft 126 and to the sleeve 148 are a plurality of pairs of slat support strings 174, 176, 178, and so on, only a portion of which are shown in FIG. 2. In FIG. 10 the strings 174, by way of example, comprise a string pair 174 and 174'. The string 174 is wrapped around a slat such as slat 180, as shown. String 174 is glued at 182 to the slat 180. String 174' is glued to the slat 180 at 184. A spot of glue 182 is adjacent one edge of slat 180 and the spot of glue 184 is at the opposite edge of slat 180. All of the slats 180, FIG. 1, are secured in a similar fashion. The strings 176, 178, and so on also comprise string pairs similar to the strings 174, 174', FIG. 10. String 174 is attached to shaft 126, FIG. 9*a*, by a spot of glue at 188 and the string 174' by a spot of glue to shaft 126 at 190. The other end of string 174 is glued to sleeve 148 by a spot of glue at 192 and the string 174' by a spot of glue at 194.

In FIG. 9*b* rotation of the shaft 126 in direction 196 wraps the string 174 about shaft 126 displacing that string 174 in direction 198 while the string 174' is wrapped around sleeve 148 moving the string 174' in direction 199. This causes the slats to rotate as shown. All of the slats rotate substantially in parallel, closing the slats. Rotation of the shaft 126 in the direction opposite 196, FIG. 9*b*, opens the slats and continued rotation to a position opposite that shown in FIG. 9*b* at the other extreme will once again close the slats. The angle for rotating the shaft 126 to achieve this action is then set in the clutch mechanisms 62 and 64 and 150 and 152.

An alternative arrangement for connecting the strings 200 and 202 which support the slats is shown in FIGS. 9*c* and 9*d*. In this case a support member 204 of rigid material is supported between the strings 200 and 202 adjacent the shaft 126 and a second like support member 206 is supported between the strings 202 and 200 adjacent sleeve 148. In FIG. 9*d* the shaft 126 is rotated in direction 208 and sleeve 148 in a direction 149 opposite to the shaft 126, whereas the shaft 126 rotates in the same direction as the sleeve 148 in FIGS. 9*a* and 9*b*. It is to be understood that the threads of shafts 28 and 30 and their direction of rotation may be set accordingly.

In operation of the structure 14, FIG. 2, as described above, when the gears 66 and 66' are rotated to their extremes so as to release their corresponding clutches and permit displacement of the shaft 126 in one of the folding directions 72, FIG. 2, this displacement tends to fold or unfold the slats. In FIG. 2, the folded portions of the strings 174 at 230 represents the drawing together or folding of the slats. The slats are drawn together at the lower part of the assembly. Assuming the assembly is vertical, the slats are drawn together at the lower part of the frame due to gravity as the shaft 126 is moved toward shaft 142 by the mechanism described. If in some other orientation then the slats may be drawn together as the mid-section of the assembly or some other locations. Rotating the assembly 90° so that the strings 174, 176, and 178 are horizontal, that is, extend from left to right across the drawing, then displacement of the shaft 126 in directions 72 is displacement in a horizontal direction. This will tend to draw the slats together adjacent to shaft 126. Assembly 14 being contained within the panes 18 and 16, FIG. 1, may be oriented in any desired orientation. Gravity is not employed to achieve the folding.

To prevent the slats from abutting the panes 16 and 18, especially when the assembly is horizontal, strings 250, 252, FIG. 11, which may be made of $PVF_2$, may be attached to side 22 of the frame 12 at one end and side 24 at the other end. Strings 256, 254 opposite strings 250, 252 may be similarly attached to sides 22 and 24. Strings 250–254 are centrally between the sides 20 and 26. A pair of strings 258 may be attached to sides 22, 24 adjacent side 26 and a second pair of strings 260 attached to sides 22 and 24 adjacent side 20. A pair of strings 262 are attached to sides 22 and 24 midway between the glass 16 and 18 adjacent sides 20 and 26, respectively. All of the above strings are between the slats and the adjacent sides or glass sheets to resiliently guide the slats and prevent the slats from contacting the glass and frame sides.

Advantageously the blind structure of FIGS. 1, 2, and 11 may be made of relatively small gears and narrow gauge shafts 28 and 30 which are sufficiently small to fit within the channel formed by sides 20, 22, 24 and 26 so that the elements forming the blind structure 14 are not visible through the glass except for shaft 126. The shaft 126 may be of smaller diameter, for example, one or two centimeters so that its appearance through the glass is not objectionable. For example, the shafts 28 and 30 may be one or two centimeters in diameter or less and the gears all may be in the order of one or two centimeters or so in diameter. The motor 54 may be a small power unit and may be battery operated. By way of example, the overall size of the structure of FIG. 1 may be 1 meter×2 meters×2 centimeters thick. The thickness of each of the panes 16 and 18 may be 5 millimeters, the slats 180 may be 7 millimeters×50 microns thick×97 centimeters long. The frame 12 sides 20, 24 may comprise aluminum sash material 12 millimeters×20 millimeters×2 meters or (1 meter). The motor 54 may develop a torque in gear 56 of 250 gram centimeters at 0.5 watts. The slats may have a width of 0.5 to 1 centimeter. The slat angles are controlled at any position of the shaft 126. The construction of FIG. 1 may be used upside down or in any other position. By operating the slats at both ends in unison, the slats are moved uniformly. The depth of the channel formed by sides 20, 22, 24, 26 may be about 12 millimeters. The strings 174, 176, 178 may be of very narrow gauge fishline of high strength. The strings 250–262 of FIG. 11 may comprise stretch threads which are elastic cords to dampen noise or rattle caused by the slats interfering with the glass panels where the assembly is employed in transportation vehicles such as cars, trains, ships, and so forth.

What is claimed is:

1. In a Venetian blind, apparatus for selectively rotating a slat and for moving the slat in a direction to lessen or increase the spacing between it and an adjacent slat comprising:

a threaded rod adapted to be rotated about its long axis;

a rotatable gear threaded about its axis of rotation, the gear threads being engaged with the rod threads; and means for selectively restraining the gear from rotation so that it moves along the length of said rod in response to the rotation of said rod about its axis, for selectively locking the gear to said rod so that said gear is selectively rotated by said rod, and coupled to and responsive to the rotation of said gear and to its movement along said rod for selectively rotating said slat and for moving said slat in said direction.

2. The apparatus of claim 1 further including means for rotating said threaded rod.

3. The apparatus of claim 1 further including a second rod parallel to the threaded rod and a second gear, said second rod and second gear being constructed and adapted to cooperate in like manner as said threaded rod and rotatable gear, said gears rotating about parallel axes, means coupling the threaded rod to said second rod and responsive to the rotation of said threaded rod for rotating said second rod therewith, and means for coupling said member to said second gear.

4. The apparatus of claim 3 wherein said means coupling the threaded rod to said second rod includes a shaft and gear means, said means for selectively restraining and for selectively locking cooperating with said gear means for rotating said shaft in unison with said gear in response to the rotation of said threaded rod.

5. The apparatus of claim 4 further including a plurality of parallel slats normal to said rods and means for coupling the slats to said shaft for rotating the slats in unison with said shaft.

6. The apparatus of claim 5 wherein said means for coupling the slats include a plurality of parallel strings attached to said shaft, said slats being secured to said strings, said shaft rotation displacing said strings for rotating said slats, the movement of said gear tending to drawing said slats together.

7. In a Venetian blind, apparatus comprising:

a first threaded shaft secured for rotation about its long axis;

first gear means in threaded engagement with said first shaft for movement in a direction along said axis in response to the rotation of said shaft;

clutch means attached to said gear means for selectively fixing said first gear means to said first shaft to rotate said gear means in response to the rotation of said shaft in one selected orientation of said gear means and to releasably couple said gear means to said shaft in a second selected orientation of said gear means so that the gear means is moved along said axis in response to the rotation of said first threaded shaft only when said clutch means is in said second orientation; and a second shaft secured for rotation about its long axis including second gear means engaged with the first gear means for rotation in response to the rotation of the first gear means and including means for maintaining said second gear means in engagement with said first gear means regardless the position of said first gear means along the axis of said first shaft.

8. A Venetian blind construction including a plurality of slats comprising:

first and second threaded shafts for rotation about respective parallel axes;

means secured to the shafts for rotating the slats about corresponding parallel axes in response to the rotation of the shafts; and slat rotating and folding means including clutch means secured to and responsive to the rotation of said threaded shafts for selectively moving said slats in a direction parallel to said shaft axes regardless the orientation of said slats and for selectively rotating said slats about said corresponding parallel axes.

9. The construction of claim 8 wherein said slat rotating and folding means includes a pair of rotatable members to which said slats are secured, each member being geared at opposite ends to a mating gear, said mating gear each being threaded to a different corresponding threaded shaft, said clutch means including means for selectively locking the mating gears of the one member to their respective threaded shafts to thereby rotate those mating gears with their shafts in response to the rotation of the corresponding threaded shafts and thereby rotate said slats therwith and for selectively releasing those mating gears with respect to the respective threaded shafts so those gears are free to rotate with respect to their threaded shafts and thereby move in said direction when said shafts rotate with respect to those gears.

10. A Venetian blind construction comprising:

a pair of parallel rods which are threaded along substantially their entire length;

a pair of parallel members normal to and coupled to said rods;

a set of parallel slats secured to said members;

two pair of gears, each pair secured to a different rod, one gear of each pair being fixed to its rod for rotation with that rod, one of said members being selectively coupled to said one gear for selective rotation in response to the rotation of at least one of said rods, the other gears of the pairs being threaded;

means for engaging the threads of the other gear of each pair to the threads of a different one of said rods, said other gears being normally locked to said rods, and clutch means for selectively unlocking said other gears in response to the rotation of said rods at the extremes of a given annular segment; and gear means for securing the other member to the other threaded gears and responsive to the rotation of said other gears for rotating said other member therewith.

11. The construction of claim 10 wherein said means for engaging and said clutch means include a gear having a threaded aperture engaged with the threads of a mating rod and a sleeve element secured to the gear normally resiliently locked to that mating rod, cam means coupled to the sleeve element for selectively releasing the sleeve element from its corresponding rod, and cam operating means for operating said cam means in response to the positioning of said threaded gear at said anngular segment extremes.

12. The construction of claim 11 wherein said cam means includes locking ring means which reduces the bore of said sleeve element to a smaller diameter than said corresponding rod, said ring means and said sleeve element each having a slit parallel to said latter rod, said cam operating means including a cam member in said ring means slit and a cam lever attached to the cam member, said lever rotating the cam member and opening said slit when its gear is at said angular segment extremes and thereby opening said sleeve element bore.

13. The construction of claim 10 wherein said one member includes a drive shaft having a gear at each end engaged with the one fixed gears and a sleeve rotatably secured to the drive shaft, and means for locking the sleeve to the drive shaft in said given angular segment.

14. The construction of claim 13 wherein the means for locking includes means for locking said other gears to the threads of said rods in said given angular segment.

15. A Venetian blind construction comprising:

first and second parallel threaded rods;

means for rotating at least one rod about its long axis;

first and second parallel cross bars;

first gear means coupling the first cross bar to said first and second rods and responsive to the rotation of said one rod for (1) rotating the first cross bar through a given angular segment and (2) displacing the first cross bar in a direction parallel to said long axis;

second gear means coupling the second cross bar to said first and second rods and responsive to the rotation of said one rod for selectively rotating the second cross bar in parallel with the rotation of said first cross bar; and means for attaching a plurality of parallel slats to said cross bars.

16. The construction of claim 15 wherein said first gear means comprises a first gear with a threaded aperture whose threads engage the threads of the first rod and a second gear with a threaded aperture whose threads engage the threads of the second rod, said second gear means including means for rotating the other rod in response to the rotation of the one rod, and clutch means coupled to said first gear means for selectively locking the first and second gears to the respective corresponding first and second rods to effect the rotation of said first cross bar in said angular segment.

17. The construction of claim 16 wherein said clutch means includes cam means attached to said first and second gears and a clutch ring around a separate different first and second rod and responsive to said cam means for selectively frictionally engaging the crests of the respective first and second rod threads.

18. The construction of claim 15 further including a frame and means for securing said rods to said frame, and string means secured to the frame adjacent the slats for guiding the slats in an aligned array regardless the orientation of the frame.

* * * * *